United States Patent [19]

Tomba et al.

[11] Patent Number: 4,645,202

[45] Date of Patent: Feb. 24, 1987

[54] PRE-SKIING EXERCISE IMPLEMENT

[75] Inventors: Silvano Tomba; Giuseppe Tomba, both of Montecchio Maggiore, Italy

[73] Assignee: Metalmeccanica Fracasso S.p.A., Venice, Italy

[21] Appl. No.: 695,031

[22] Filed: Jan. 25, 1985

[30] Foreign Application Priority Data

Jan. 25, 1984 [IT] Italy ..... 85510 A/84
Mar. 6, 1984 [IT] Italy ..... 85537 A/84

[51] Int. Cl.[4] ..... A63B 69/18
[52] U.S. Cl. ..... 272/97
[58] Field of Search ..... 272/97, 70, 146; 434/253

[56] References Cited

U.S. PATENT DOCUMENTS 2,573,808 11/1951 Ravoire ..... 434/253
3,364,875 1/1968 Bilaisis ..... 272/97
3,591,172 7/1971 Hude ..... 272/97
3,708,163 1/1973 Hynes ..... 272/97
3,807,727 4/1974 Ferguson ..... 272/97

FOREIGN PATENT DOCUMENTS 474274 8/1969 Switzerland ..... 272/97
0886917 12/1981 U.S.S.R. ..... 272/97

*Primary Examiner*—Richard J. Apley
*Assistant Examiner*—S. R. Crow
*Attorney, Agent, or Firm*—Pollock, Vande Sande & Priddy

[57] ABSTRACT

A pre-skiing exercise device which permits body and leg movements similar to those performed when turning (Christiania-like) to the right and to the left during a downhill run. The device comprises two support bars (2) in parallel, side-by-side relation and arranged for attachment of ski-boots, either directly or through the respective ski (4). The rear sections of the support bars (2) slidably bear on an inverted V-shaped supporting cross member (6), and at an intermediate position on an articulated bar-supporting device (7), in which each of the bars (2) can rock independently of the other about an associated horizontal axis of inclination (X) transversal thereto, and both bars (2) can simultaneously perform concordant equal angular movements around associated upstanding axes of rotation (Y), which are vertical or preferably inclined rearwardly toward the inverted V rear supporting cross member (6).

13 Claims, 14 Drawing Figures

PRE-SKIING EXERCISE IMPLEMENT

FIELD OF THE INVENTION

The invention relates to an implement for pre-skiing exercises, i.e., an implement enabling a user to perform in a gymnasium or at home body and leg movements in order to train himself for skiing.

The purpose of the invention is to provide a pre-skiing exercise implement for doing gymnastic exercises reproducing the movements of the body and especially of the legs of a user when turning to the left and to the right with a pair of skis.

The invention aims to provide a strong, cheap and simple implement of the aforementioned kind, which will simulate as accurately as possible the conditions in which a skier must move when turning (Christiania-like) during a downhill run.

SUMMARY OF THE INVENTION

This aim is attained by the invention with the provision of a pre-skiing exercise implement which comprises two support bars set in a parallel, side-by-side relation, just like a pair of skis, and provided with means for fastening to each of them a ski-boot, either directly or through a respective one of the skis; these support bars have their rear end sections slidably bearing on a supporting cross member which is shaped like an inverted V, and at an intermediate position are supported by an articulated bar-supporting device where each one of the bars can rock, independently from the other bar, around an associated horizontal axis of inclination which is transversal thereto, and both bars can simultaneously perform concordant equal angular movements around associated upstanding axes of rotation.

A user of this device, by mounting and standing on the support bars, with his feet fitted into the ski-boots being fastened either directly or through a standard ski pair onto the said support bars, and by bearing with his hands on standard ski-poles, or on a special support, causes the two support bars to swing alternatively to the right and to the left around their upstanding axes of rotation, with a simultaneous, equal and concordant movement, so that the two support bars will remain parallel to each other. At the same time, the rear ends of the support bars are alternatively shifted from the one to the other of the two sloping sides of the inverted V supporting cross member, thus changing their inclination and rocking accordingly around the associated horizontal axes of inclination. The inclination of the two support bars may differ with respect to each other, and they are set in different planes according to the different level at which their rear ends come to be positioned onto the sloping sides of the inverted V supporting cross member. In this way, the movement of a skier in the course of a downhill run to alternately turn to the right and to the left (Christiania-like), will be simulated with a considerable approximation.

The upstanding axes of rotation of the two support bars may be vertical axes. The movements of the body and the legs of a user when turning during a down-hill run on a pair of skis will be simulated by the pre-skiing exercise implement of the invention with a still greater approximation when, according to a further feature of the invention, the upstanding axes of rotation of the support bars are inclined rearwardly toward the inverted rear supporting cross member.

The inverted V rear supporting cross member may be either a fixed member, or a level-adjustable member, and/or it may be replaced with other cross members having a different height and/or shape, particularly a more or less great inclination of both sloping sides of said bar-supporting cross member. In this way, it is possible to change the conditions in which the simulated turns are made as with a pair of skis, and therefore it is possible to modify and, for example, increase gradually the difficulties of a pre-skiing training.

BRIEF DESCRIPTION OF THE DRAWINGS

Some embodiments of the pre-skiing exercise implement according to the invention will be described more in detail hereinbelow by referring to the accompanying drawings, in which.

FIGS, 2, 3, and 4 diagrammatically show different positions of the support bars on the inverted V rear supporting cross member.

Figure 1:
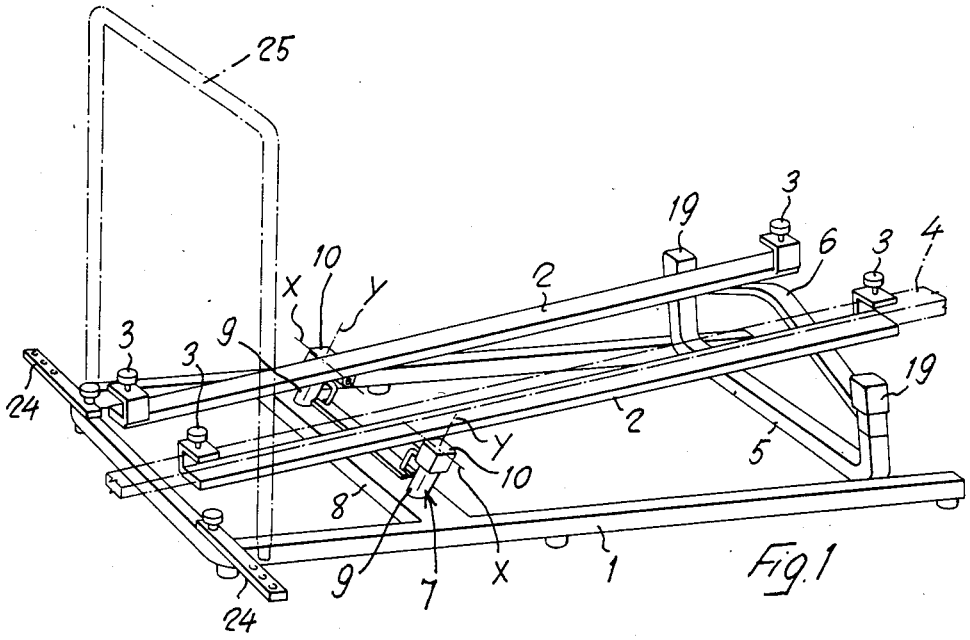
FIG. 1 shows in perspective view a pre-skiing exercise implement.
Figure 5:
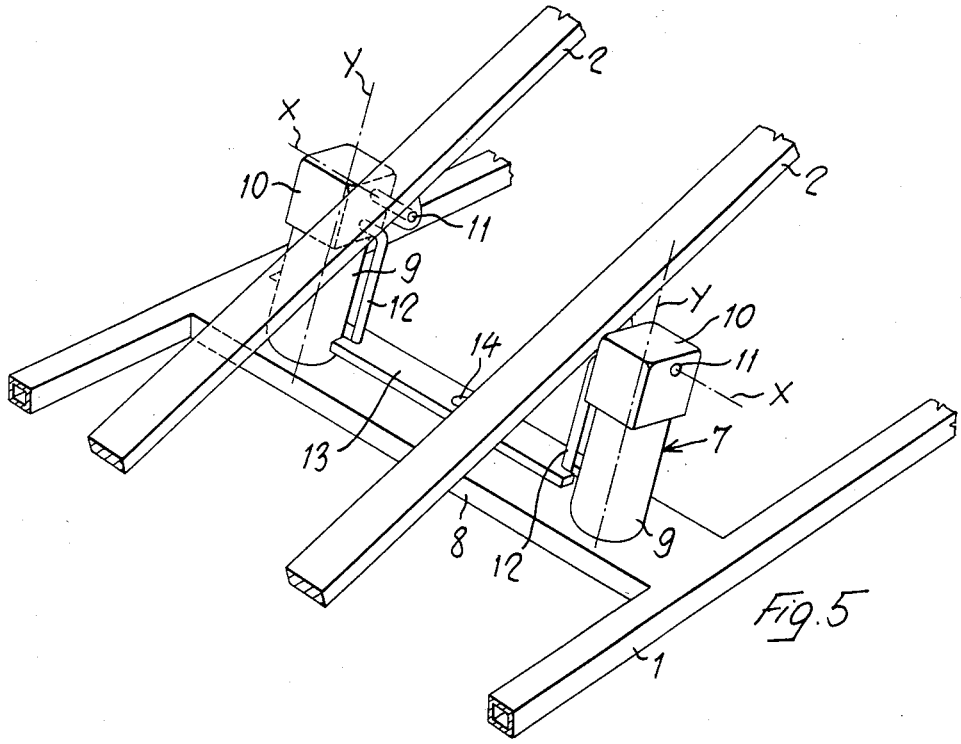
Figure 6:
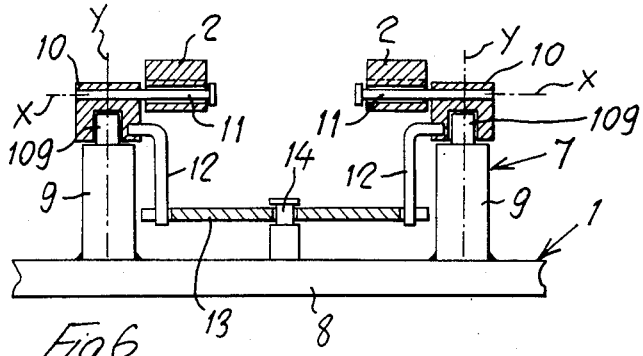
Figure 7:
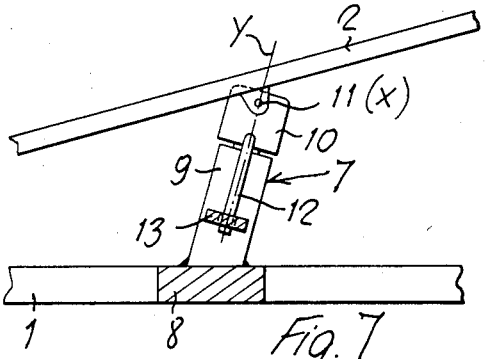

FIGS. 5, 6 and 7 respectively show, in perspective, in vertical cross-section and in longitudinal vertical section, the articulated bar-supporting device in the implement according to FIG. 1.

Figure 8:
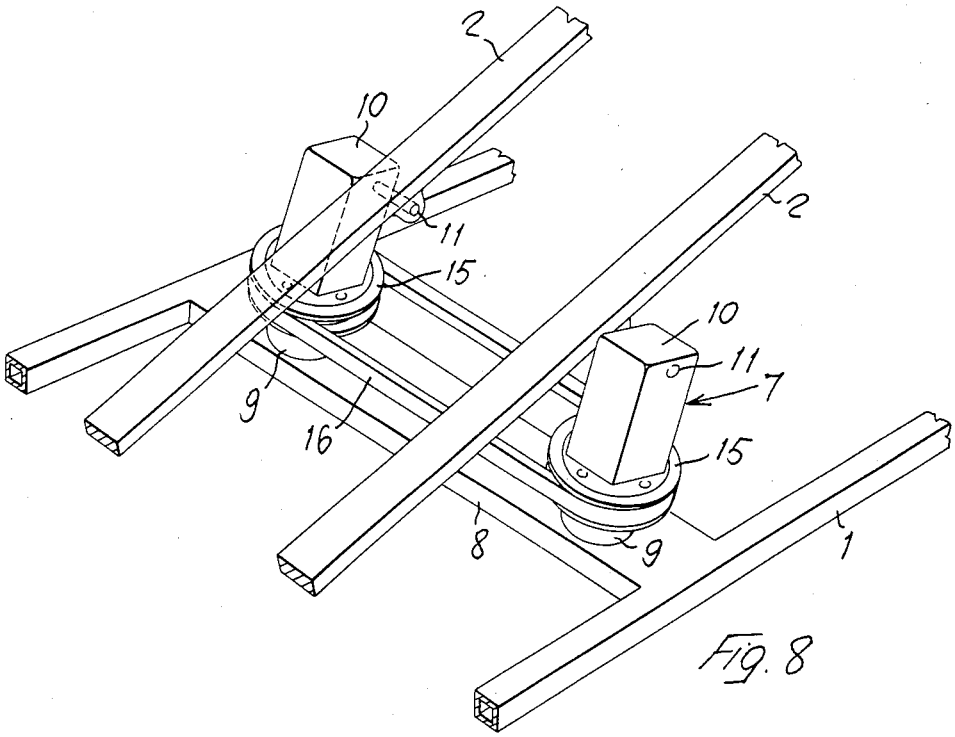
Figure 9:
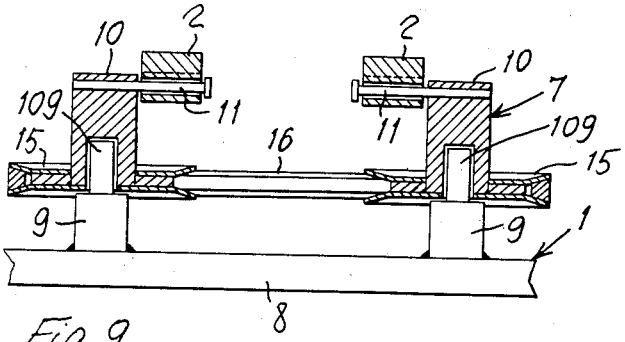
Figure 10:
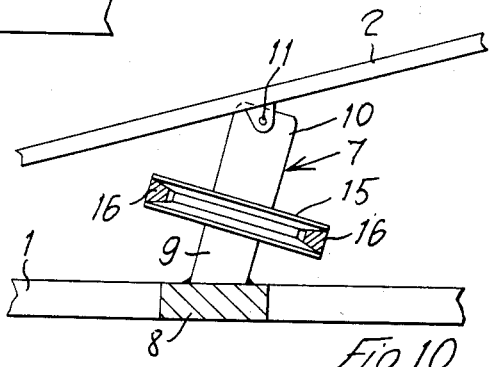

FIGS. 8, 9 and 10 respectively show in perspective, in cross-section and in longitudinal section, a further embodiment of the articulated bar-supporting device.

Figure 11:
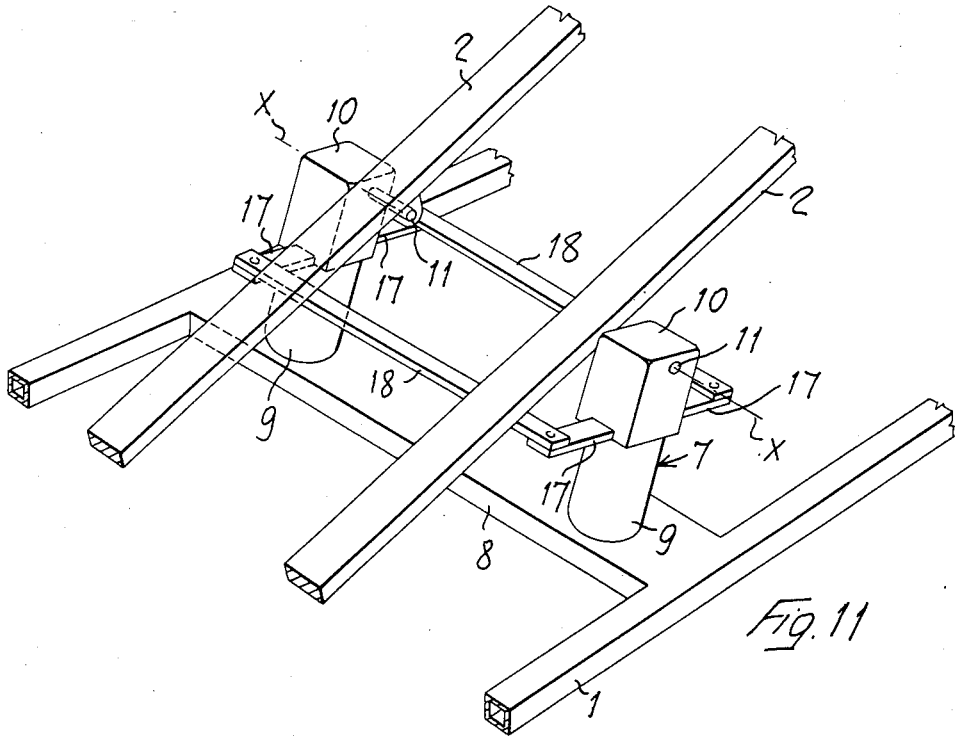
Figure 12:
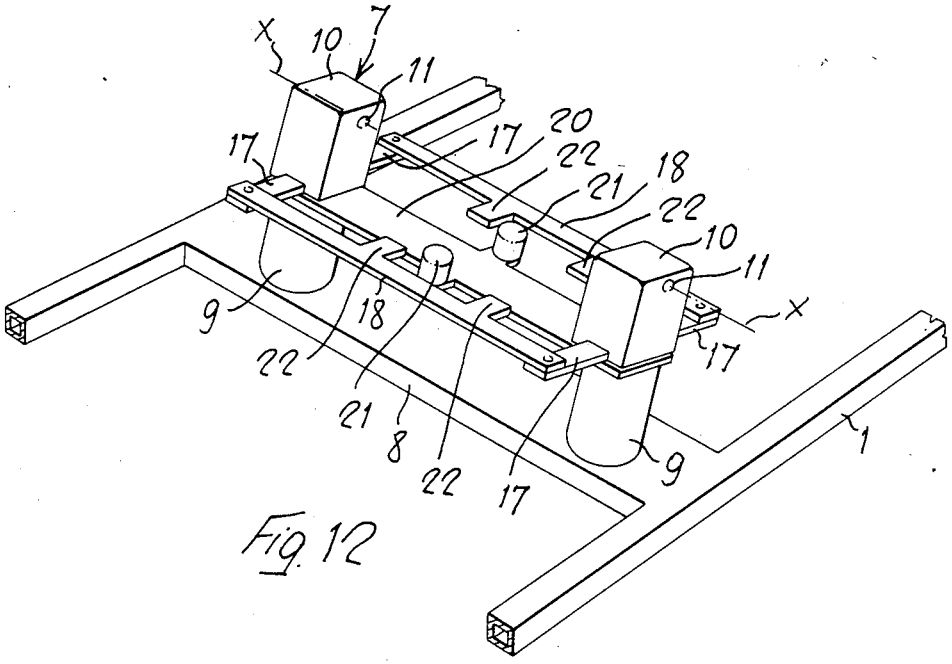
Figure 13:
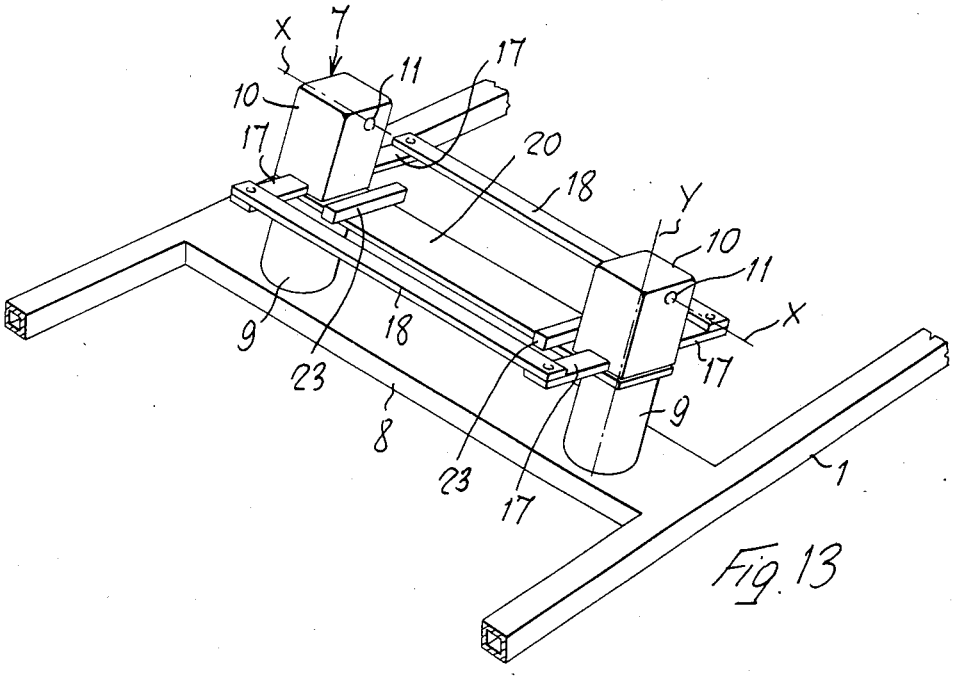

FIGS. 11, 12 and 13 respectively show three other embodiments of the articulated bar-supporting device.

Figure 14:
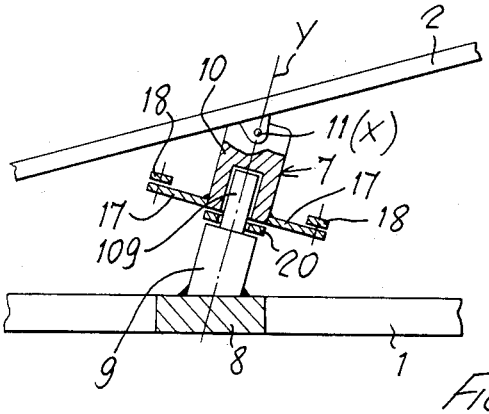

FIG. 14 is a longitudinal sectional view of the articulated bar-supporting device according to FIG. 13.

DESCRIPTION OF SOME PREFERRED EMBODIMENTS

Referring to FIG. 1, the pre-skiing exercise implement consists a base frame 1 resting on the floor and carrying two parallel flat support bars 2. As illustrated, the support bars 2 are provided with clamps 3 by means of which one of the skis 4, shown in dash-and-dot lines, can be temporaneously fastened onto each one of the bars 2.

At its rear end, the base frame 1 has a U-shaped cross member 5. Into the tubular vertical rods of this U-shaped cross member 5 a supporting cross member 6 having the shape of an inverted V with a preferably rounded apex is fitted from above by means of corresponding lower pivots (not shown). This inverted V supporting cross member 6 is preferably replaceable by other similar cross members having different heights and/or differently inclined sloping sides.

Both support bars 2 are supported at an intermediate position by an articulated bar-supporting unit 7, which is provided on a cross member 8 of the base frame 1. On this articulated bar-supporting unit each one of the bars 2 can rock independently of the other bar, around an associated horizontal axis of inclination X, which is transversal thereto. Moreover, both bars 2 can simultaneously perform concordant equal angular movements around associated axes of rotation Y, which are either vertical or preferably inclined rearwardly toward the inverted V rear supporting cross member 6, as clearly shown particularly in FIGS. 7, 10 and 14. The rear ends of the two support bars 2 slidably bear on the inverted V rear supporting cross member 6.

In all of the illustrated embodiments, the articulated bar-supporting unit 7 comprises two posts 9 which are secured to the cross member 8 of the base frame 1, and are oriented according to the axes of rotation Y of the support bars 2, i.e., the said posts 9 are parallel to each other, and are either vertical or rearwardly inclined. Onto the tapered upper end 109 of each post 9 (FIGS. 6, 9 and 14) there is rotatably mounted a bar-carrying head 10, to one side of which the respective bar 2 is pivotally connected by means of a horizontal pivot 11 for the rocking of this bar 2, which forms the axis of inclination X. For the sake of greater clarity, the support bars 2 have been omitted in FIGS. 12 and 13, where only the horizontal pivots 11 for rocking them are shown.

The bar-carrying heads 10 which are rotatable on the posts 9 are interconnected so as to obtain equal concordant rotational movements of said heads 10, and therefore of the support bars 2 along with the horizontal pivots 11 for the rocking of said bars around the axes Y. This connection can be made in several ways. In the embodiment according to FIGS. 5, 6 and 7, each bar-carrying head 10 is made at its inner side integral with an eccentric stem 12 extending downward parallely to post 9, i.e., parallel to the axis of rotation Y. By their lower free ends the eccentric stems 12 of the two bar-carrying heads 10 are engaged in the opposite ends of a connection swingable lever 13 intermediately fulcrumed about a pivot 14 which is parallel to the axes of rotation Y, and is secured to the cross member 8 of the base frame 1. It is obvious that when one bar-carrying head 10 is caused to rotate with the bar 2, for example in a clockwise direction, around the respective axis Y, it drives the connection lever 13 through its eccentric stem 12 and causes this lever to swing in a counterclockwise direction about pivot 14. The said connection lever 13 in turn drives through its eccentric stem 12 the other bar-carrying head 10, and causes the latter to rotate with the bar 2 around the respective axis Y, in the same clockwise direction and through the same angle as the first bar-carrying head 10.

In the embodiment according to FIGS. 8, 9 and 10, the two bar-carrying heads 10 are each integral with a pulley 15 and are interconnected by means of a smooth V-belt 16 guided around pulleys 15. In lieu of a smooth V-belt 16, a toothed belt may be used, and in that case the pulleys 16 will be replaced with cogwheels. In both cases, the rotation of one bar-carrying head 10 in one direction around the respective axis Y promotes a rotation of the other bar-carrying head 10 around its axis Y, in the same direction and through the same angle, and vice-versa.

In the embodiments according to FIGS. 11 to 14, each bar-carrying head 10 is made integral with at least one radially extending arm 17, and preferably with two radially extending, diametrically opposite arms 17. The two radially extending arms 17, which are parallel to each other and project from corresponding sides of the bar-carrying heads 10, are pivotally connected by means of a transversal link rod 18, whereby an articulated parallelogram is formed, which ensures concordant equal rotational movements of both bar-carrying heads 10, and therefore of both support bars 2, around the axes Y.

In all of the illustrated embodiments, the rotational movements of both support bars 2 around the axes Y are restrained by suitable abutment stop members.

In the embodiments according to FIGS. 1 to 11, at the ends of the inverted V rear supporting cross member 6, abutment stop members 19 are provided for the rear ends of the support bars 2.

In the embodiment according to FIG. 12, between the two posts 9 of the articulated bar-supporting device 7 there is fixed a cross member 20 that on each one of its sides centrally carries an abutment stop member 21 which cooperates with two spaced apart stop projections 22 that are provided on the corresponding link rod 18 for the radially extending arms 17 on the bar-carrying rotatable heads 10. During the rotational movement of the bar-carrying heads 10 around the respective axes Y, the link rods correspondingly move in their longitudinal direction, so that their stop projections 22 alternatively abut against the associated abutment stop members 21 on the fixed cross member 20.

In the embodiment according to FIG. 13, the abutment stop members 23 that restrict the rotational movements around the axes Y of both bar-carrying heads 10, and therefore of the support bars 2, are fastened onto both ends of the fixed cross bar 20, and alternatively cooperate each with the two diametrically opposite, radially extending arms 17 on the adjoining bar-carrying head 10.

FIG. 14 clearly shows that the cross member 20, which carries the abutment stop members 21 or 23 according to FIGS. 12 and 13, can be mounted on posts 9 by means of bores provided in the ends of said cross member 20, whereby this cross member will be fitted in the tapered upper ends 109 of posts 9, underneath the rotatable bar-carrying heads 10.

At the front end of the base frame 1, i.e., on the side opposite to the inverted V supporting cross member 6, there are fastened two transverse side bars 24 provided with holes, as shown particularly in FIG. 1. A user of the above-described implement gets on the two support bars 2 and wears the boots directly fastened on these bars 2, or carried by the skis 4 that through clamps 3 are fastened to the support bars 2. The user then bears with his hands on standard ski-poles with the ends thereof fitted into the holes in the two fore side bars 24. As an alternative, the user can hold on by his hands to a handle bar 25 shaped like an inverted U and fitted by its bottom ends into the holes in the two fore side bars 24, as shown in dash-and-dot lines in FIG. 1.

Figure 2:
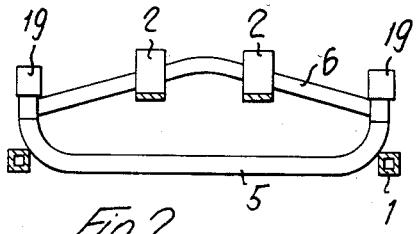
Figure 3:
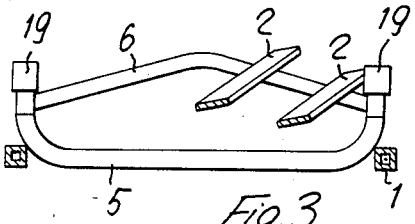
Figure 4:
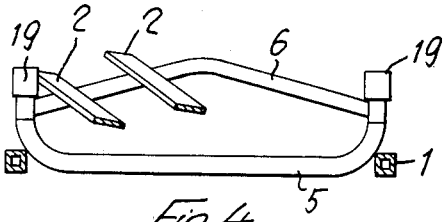

When in such a position, the user will perform a number of body and leg movements which are similar to those being performed when skiing, during a downhill run with a succession of alternating turns (Christiania-like) to the right and to the left. The support bars 2 are accordingly rotated alternatively to the right and to the left around the vertical or inclined axes Y, while being kept parallel to each other, and with their rear ends being alternatively moved along the oppositely sloping sides of the inverted V-shaped, bar-supporting rear cross member 6, as shown in FIGS. 3 and 4. At the same time, the support bars 2 change their inclination by rocking around their transverse horizontal axes of inclination X. When the two support bars 2 are situated in a symmetrical position on opposite sides of the apex of the inverted V rear supporting cross member 6, they are in a coplanar relation, as shown in FIG. 2. In any other position, while being kept parallel to each other, the two support bars take a different inclination, depending on the different level at which their rear ends come to be positioned, and are even set in different planes, owing to their capability of rocking independently from each other around the respective transverse horizontal axes of inclination X, and thanks to the rearward inclination of their axes of rotation Y, as clearly shown in FIGS. 3 and 4.

We claim:

1. A pre-skiing exercise device comprising two support bars (2) in parallel, side by side relation, and provided with means (3) for attachment thereto of a ski-boot, said support bars (2) having rear end sections slidably bearing on an inverted V rear supporting cross member (6), and supported at an intermediate position by an articulated bar-supporting device (7) on which each of said bars (2) can rock independently of the other bar about an associated horizontal axis of inclination (X) transversal thereto, both bars being allowed to simultaneously perform coordinated equal angular movements about associated upstanding axes of rotation (Y), said bar-supporting device being pivotally connected by means of a transverse horizontal pivot (11), coinciding with the axis of inclination (X), to a bar-carrying head (10) which is rotatably mounted onto a fixed post (9, 109) coinciding with the axis of rotation (Y), the two bar-carrying heads (10) being interconnected so as to be caused to simultaneously perform coordinated equal rotational movements.

2. Device according to claim 1, wherein the upstanding axes of rotation Y of said support bars (2) are inclined rearwardly toward said cross member (6).

3. Device according to claim 1, wherein said cross member (6) is adjustable in height.

4. Device according to claim 1, wherein said cross member is replaceable by other cross members having different configurations.

5. Device according to claim 1, wherein both bar-carrying heads (10) have eccentric extensions (12) in engagement with opposite ends of a swingable connection lever (13) intermediately fulcrumed about a pivot (14) which is parallel to the axes of rotation (Y) of said bar-carrying heads (10).

6. Device according to claim 1, wherein both bar-carrying heads (10) are made integral with pulleys (15) interconnected by means of a belt (16).

7. Device according to claim 1, wherein both bar-carrying heads (2) have at least two radially extending parallel arms (17) pivotally connected through a transverse rod (18), whereby an articulated parallelogram is formed.

8. Device according to claim 1, comprising abutment stop members (19, 21, 23) for restraining in either direction the angular movement of said support bars (2) about the axes of roation (Y).

9. Device according to claim 8, wherein said stop abutment members (19) are provided at the ends of said cross member (6).

10. Device according to claim 7, comprising stop abutment members (21) intermediately provided on a cross bar (22) which is fixed between said two posts (9), and cooperating with stop projections (22) on the transverse rod (18) for linking said radially extending arms (17) of said bar-carrying heads (10).

11. Device according to claim 7, comprising abutment stop members (23) at the ends of a cross bar (20) which is fixed between said two posts (9), and cooperating with said radially extending arms (17) of said bar-carrying heads (10).

12. Device according to claim 1, wherein, on its end opposite to the inverted V supporting cross member (6), said device is provided with perforated support means (24) for the reception of ski-poles.

13. Device according to claim 1, wherein on its end opposite to the inverted V supporting cross member (6), said device is provided with perforated support means (24) for the reception of an inverted U-shaped handle bar (25).

* * * * *